US008746854B2

(12) United States Patent
Yoshida et al.

(10) Patent No.: US 8,746,854 B2
(45) Date of Patent: Jun. 10, 2014

(54) LIQUID EJECTION HEAD AND IMAGE FORMING APPARATUS INCLUDING THE LIQUID EJECTION HEAD

(75) Inventors: Takahiro Yoshida, Kanagawa (JP); Hiroomi Yokomaku, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/417,417

(22) Filed: Mar. 12, 2012

(65) Prior Publication Data

US 2012/0236080 A1 Sep. 20, 2012

(30) Foreign Application Priority Data

Mar. 18, 2011 (JP) ..... 2011-060318

(51) Int. Cl.
*B41J 2/045* (2006.01)

(52) U.S. Cl.
USPC ..... 347/68; 347/70; 347/71; 347/72

(58) Field of Classification Search
USPC ..... 347/68–72, 65, 6
See application file for complete search history.

(56) References Cited

U.S. PATENT DOCUMENTS

| | | | |
|---|---|---|---|
| 7,264,338 | B2 | 9/2007 | Ogata et al. |
| 7,520,579 | B2 | 4/2009 | Yoshida |
| 7,527,351 | B2 | 5/2009 | Hirano et al. |
| 7,810,909 | B2 | 10/2010 | Shingyohuchi |
| 7,901,034 | B2 | 3/2011 | Yoshida |
| 7,950,758 | B2 | 5/2011 | Yoshida |
| 8,057,001 | B2 | 11/2011 | Shingyohuchi et al. |
| 2007/0126802 | A1* | 6/2007 | Shingyohuchi ..... 347/68 |
| 2008/0117262 | A1 | 5/2008 | Mori et al. |
| 2009/0102907 | A1 | 4/2009 | Yamanaka et al. |
| 2011/0096113 | A1 | 4/2011 | Yoshida |

FOREIGN PATENT DOCUMENTS

| | | |
|---|---|---|
| CN | 1162288 | 10/1997 |
| CN | 1576002 | 2/2005 |
| CN | 1576011 | 2/2005 |
| CN | 101229714 | 7/2008 |
| JP | 2007-144706 | 6/2007 |
| JP | 2007-176153 | 7/2007 |

OTHER PUBLICATIONS

Chinese official action dated Jan. 6, 2014 in corresponding. Chinese patent application No. 2012 10 06 6564.6.

* cited by examiner

*Primary Examiner* — Henok Legesse
(74) *Attorney, Agent, or Firm* — Cooper & Dunham LLP

(57) ABSTRACT

A liquid ejection head includes a channel plate, a diaphragm member, and a piezoelectric member. The channel plate includes a separate liquid chamber, a fluid resistance portion, and a liquid introducing portion. The diaphragm member has a thin layer and a thick layer. The thin layer forms a wall face of each of the separate liquid chamber, the resistance portion, and the introducing portion and includes a vibration area facing the separate liquid chamber. The piezoelectric member is arranged to deform the vibration area and has a portion opposing the introducing portion. The thin layer has a thin portion forming the wall face of the introducing portion. The thick layer has a thick portion formed along the longitudinal direction of the separate liquid chamber on a first face opposite a second face opposing the introducing portion. In a plan view, the thin portion is divided by the thick portion.

9 Claims, 13 Drawing Sheets

LIQUID EJECTION HEAD AND IMAGE FORMING APPARATUS INCLUDING THE LIQUID EJECTION HEAD

CROSS-REFERENCE TO RELATED APPLICATION

This patent application is based on and claims priority pursuant to 35 U.S.C. §119 to Japanese Patent Application No. 2011-060318, filed on Mar. 18, 2011, in the Japan Patent Office, the entire disclosure of which is hereby incorporated by reference herein.

BACKGROUND

1. Technical Field

This disclosure relates to a liquid ejection head and an image forming apparatus including the liquid ejection head.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid ejection head or liquid-droplet ejection head) for ejecting droplets of ink. During image formation, such inkjet-type image forming apparatuses eject droplets of ink or other liquid from the recording head onto a recording medium to form a desired image. The inkjet-type image forming apparatuses fall into two main types: a serial-type image forming apparatus that forms an image by ejecting droplets from the recording head while moving a carriage mounting the recording head in a main scanning direction, and a line-head-type image forming apparatus that forms an image by ejecting droplets from a linear-shaped recording head held stationary in the image forming apparatus.

As one type of the liquid ejection head, a piezoelectric recording head is known that has a channel plate, a diaphragm member, and a piezoelectric member. The channel plate includes separate liquid chambers (also referred to as pressurizing chambers, pressure chambers, separate chambers, liquid pressurizing chambers, or liquid pressure chambers) communicating with respective nozzles for ejecting liquid droplets, fluid resistance portions communicating with the separate liquid chambers, and liquid introducing portions to introduce liquid from a common liquid chamber to supply the liquid to the separate liquid chambers. The diaphragm member has a thick part and a thin part that forms wall faces of the separate liquid chambers, the fluid resistance portions, and the liquid introducing portions. The piezoelectric member deforms vibration areas of the diaphragm member opposing the separate liquid chambers.

For the piezoelectric recording head, there is and has been a trend of the downsizing of the separate liquid chambers to form high-quality images at high speed. As a result, the length of the piezoelectric member (piezoelectric element) in the longitudinal direction is likely to be longer than the length of the separate liquid chamber in the longitudinal direction (i.e., a direction perpendicular to the lateral direction in which the separate liquid chambers are arrayed). Furthermore, in the longitudinal direction, the piezoelectric element may extend to the liquid introducing portion across the fluid resistance portion.

In the case where the diaphragm member has the two-layer structure of thin part and thick part, if the length of the piezoelectric element in the longitudinal direction is relatively great as described above, areas of the diaphragm member forming wall faces of the fluid resistance portions and the liquid introducing portions are preferably made of the thin part to prevent interference of the diaphragm member with the piezoelectric element.

However, if the wall faces of the liquid introducing portions and the fluid resistance portion are formed of the thin part, the thin part may vibrate due to fluctuations in pressure on ejection of droplets, thus creating a natural vibration having a mode differing from the natural vibration mode of the separate liquid chamber. As a result, the control performance of droplet ejection may decrease, thus degrading the ejection performance.

Hence, for example, JP2007-144706-A1 proposes a liquid ejection head in which each fluid resistance portion is bent from a corresponding separate liquid chamber so as to overlap a thick part of the diaphragm member.

Additionally, JP2007-176153 proposes a liquid ejection head in which, in the longitudinal direction of the liquid pressure chamber, the length of the pressure generator (piezoelectric element) is greater than the length of the liquid pressure chamber, and an end portion of the pressure generator proximal to a supply channel is disposed at a position opposing an area of the diaphragm member facing the liquid pressure chamber without opposing another area of the diaphragm member facing the supply channel.

However, in the configuration described in JP2007-144706-A1, in a case where the piezoelectric member extends to the liquid introducing portion disposed upstream from the fluid resistance portion, natural vibration may occur in an area of the diaphragm member forming a wall face of the liquid introducing portion. Further, in a case where the channel plate is formed by etching a silicon substrate, the configuration of the fluid resistance portion described in JP2007-144706-A1 cannot be formed.

In the configuration described in JP2007-176153, a thick portion of the diaphragm member is bonded to the piezoelectric element at a position offset to one side of the piezoelectric element. However, if the thick portion of the diaphragm member is disposed in the middle of the piezoelectric element, the diaphragm member interferes with the piezoelectric element unless an area of the diaphragm member forming a wall face of each fluid resistance portion is formed of the thin part. Therefore, the above-described challenge remains unsolved that natural vibration occurs in other areas of the thin part except for the vibration area opposing the liquid pressure chamber.

BRIEF SUMMARY

In an aspect of this disclosure, there is provided a liquid ejection head including a channel plate, a diaphragm member, and a piezoelectric member. The channel plate includes a separate liquid chamber communicating with a nozzle to eject droplets of liquid, a fluid resistance portion communicating with the separate liquid chamber, and a liquid introducing portion communicating with the fluid resistance portion to introduce the liquid from a common liquid chamber. The diaphragm member has a thin layer and a thick layer. The thin layer forms a wall face of each of the separate liquid chamber, the fluid resistance portion, and the liquid introducing portion. The thin layer includes a vibration area facing the separate liquid chamber. The piezoelectric member is arranged to deform the vibration area facing the separate liquid chamber and has a portion opposing the liquid introducing portion at one end in a longitudinal direction of the separate liquid chamber perpendicular to a lateral direction of the separate liquid chamber. The thin layer of the diaphragm member has a thin portion forming the wall face of the liquid introducing portion. The thick layer of the diaphragm member has a first thick portion formed along the longitudinal direction of the separate liquid chamber on a first face of the thin layer opposite a second face of the thin layer opposing the liquid introducing portion. In a plan view, the thin portion forming the wall face of the liquid introducing portion is divided by the first thick portion formed along the longitudinal direction of the separate liquid chamber.

In another aspect of this disclosure, there is provided a liquid ejection head including a channel plate, a diaphragm member, and a piezoelectric member. The channel plate includes a separate liquid chamber communicating with a nozzle to eject droplets of liquid, a fluid resistance portion communicating with the separate liquid chamber, and a liquid introducing portion communicating with the fluid resistance portion to introduce the liquid from a common liquid chamber. The diaphragm member has a thin layer and a thick layer. The thin layer forms a wall face of each of the separate liquid chamber, the fluid resistance portion, and the liquid introducing portion. The thin layer includes a vibration area facing the separate liquid chamber. The piezoelectric member is arranged to deform the vibration area facing the separate liquid chamber. The piezoelectric member has a portion opposing the liquid introducing portion at one end in a longitudinal direction of the separate liquid chamber perpendicular to a lateral direction of the separate liquid chamber. The thin layer of the diaphragm member has a thin portion forming the wall face of the liquid introducing portion. The channel plate has a support portion formed along the longitudinal direction of the separate liquid chamber and bonded to the thin portion. In a plan view, the thin portion forming the wall face of the liquid introducing portion is divided by the support portion formed along the longitudinal direction of the separate liquid chamber.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
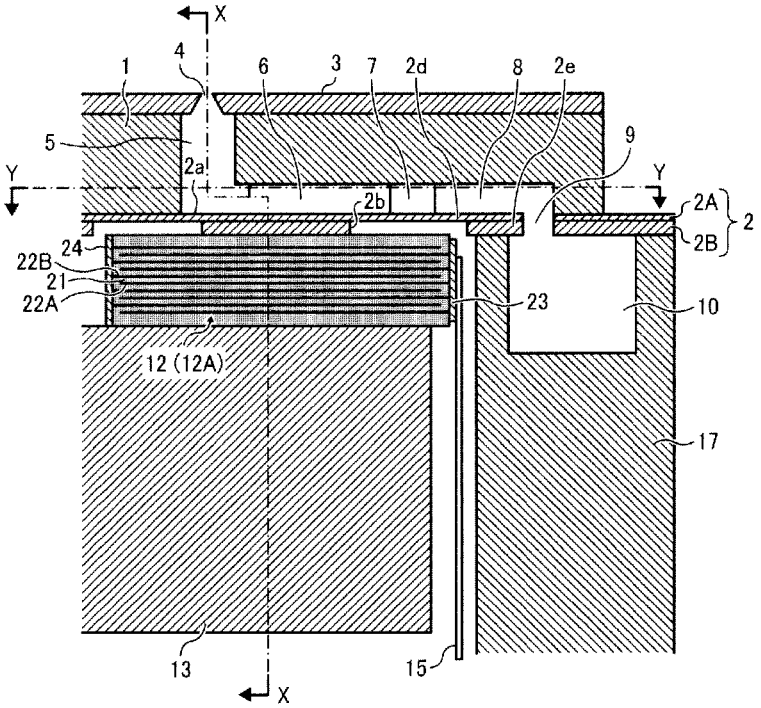
FIG. 1 is a partial sectional view of a liquid ejection head according to an exemplary embodiment of this disclosure cut along a longitudinal direction of a liquid pressure chamber.

The accompanying drawings are intended to depict exemplary embodiments of the present disclosure and should not be interpreted to limit the scope thereof The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" employing a liquid-ejection recording method refers to an apparatus (e.g., droplet ejection apparatus or liquid ejection apparatus) that ejects ink or any other liquid onto a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images, such as characters and figures, but meaningless images, such as patterns, to the medium (in other words, the term "image formation" includes only causing liquid droplets to land on the medium). The term "ink" as used herein is not limited to "ink" in a narrow sense and includes any types of liquid useable for image formation, such as a recording liquid, a fixing solution, a DNA sample, and a pattern material. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, or a recording sheet. The term "image" used herein is not limited to a two-dimensional image and includes, for example, an image applied to a three dimensional object and a three dimensional object itself formed as a three-dimensionally molded image.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, a liquid ejection head according to an exemplary embodiment of this disclosure is described with reference to FIGS. 1 and 2.

FIG. 1 is a partial sectional view of the liquid ejection head cut along a longitudinal direction of a liquid pressure chamber. FIG. 2 is a partial sectional view of the liquid ejection head cut along a line X-X of FIG. 1 in a lateral direction of the liquid pressure chamber.

Figure 2:
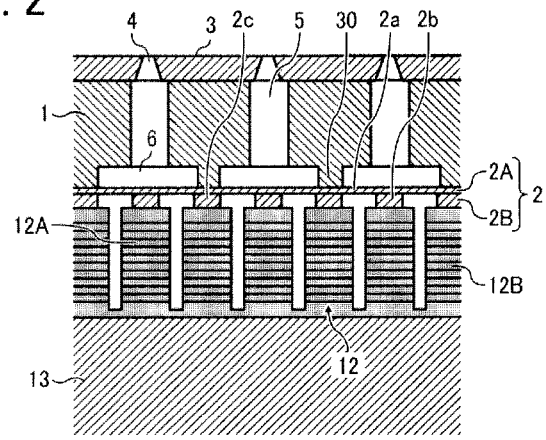
FIG. 2 is a partial sectional view of the liquid ejection head cut along a line X-X of FIG. 1 in a lateral direction of the liquid pressure chamber.

In FIGS. 1 and 2, the liquid ejection head includes a channel plate 1 (also referred to as channel substrate or liquid chamber substrate) serving as a channel member, a diaphragm member 2 bonded to a lower face of the channel plate 1, and a nozzle plate 3 bonded to an upper face of the channel plate 1. The channel plate 1, the diaphragm member 2, and the nozzle plate 3 form nozzle communication channels 5 (communication ducts), liquid pressure chambers 6, fluid resistance portions 7, and liquid introducing portions 8. The liquid pressure chamber 6 (hereinafter, also referred to as simply "liquid chamber") serving as separate liquid chamber communicates, via the nozzle communication channel 5, with a nozzle 4 for ejecting droplets of liquid. From a common liquid chamber 10 formed in a frame member 17, ink is introduced to the liquid introducing portion 8 through an inlet 9 formed in the diaphragm member 2, and delivered from the liquid introducing portion 8 to the pressure chamber 6 via the fluid resistance portion 7. The nozzle plate 3 may be integrally molded with the channel plate 1.

The channel plate 1 is produced by anisotropically etching a silicon substrate so as to have openings and channels, such as the nozzle communication channels 5, the liquid pressure chambers 6, the fluid resistance portions 7, and the liquid introducing portions 8. After the channel plate 1 is etched to form the nozzle communication channels 5, the liquid pressure chambers 6, and so forth, remaining parts form inter-channel partitions 30 (inter-chamber partitions).

The diaphragm member 2 is a wall member forming a wall face of each of the liquid pressure chamber 6, the fluid resistance portion 7, and the liquid introducing portion 8, and has a deformable first layer 2A and a second layer 2B laminated on the first layer 2A. The diaphragm member 2 also has vibration areas 2*a* (diaphragm portions) which are thin portions of the deformable first layer 2A forming wall faces of the liquid pressure chambers 6. Piezoelectric pillars 12A of a lamination-type piezoelectric member 12 are bonded to insular convex portions 2*b* of the second layer 2B so as to face the vibration areas 2*a*. The piezoelectric pillars 12A are pillar-shaped electromechanical transducers serving as driving elements (actuator devices or pressure generators) to deform the vibration areas 2*a* and generate energy for ejecting liquid droplets.

The piezoelectric member 12 is produced by half-cut dicing so as to have the piezoelectric pillars 12A and piezoelectric pillars 12B in comb shape. The piezoelectric pillars 12A serve as driving piezoelectric pillars applied with driving waveforms. The piezoelectric pillars 12B serve as non-driving piezoelectric pillars to support the inter-channel partitions 30 without being applied with driving waveforms. In other words, the piezoelectric pillars 12A and 12B of the piezoelectric member 12 have a bi-pitch structure in which the piezoelectric pillars 12A and 12B are arranged at a density which is double a density at which the liquid pressure chambers 6 are arranged. A lower end surface of the piezoelectric member 12 is bonded to a base member 13.

The driving piezoelectric pillars 12A are bonded with adhesive to the insular convex portions (thick portions) 2*b* facing the vibration areas 2*a* in the diaphragm member 2. The non-driving piezoelectric pillars 12B are bonded with adhesive to thick portions 2*c* of the diaphragm member 2 that are disposed corresponding to the inter-channel partitions 30.

In the piezoelectric member 12, for example, piezoelectric layers 21 of lead zirconate titanate (PZT) having a thickness of 10 to 50 μm per layer and each of internal electrode layers 22A and 22B of silver palladium (AgPd) having a thickness of a few μm per layer are alternately laminated. Internal electrodes of the internal electrode layers 22A and 22B are electrically connected to an individual electrode 23 and a common electrode 24, respectively, which are end-surface electrodes (external electrodes) mounted on end surfaces of the driving piezoelectric pillar 12A. Individual electrode lines of a flexible printed circuit (FPC) 15 are connected to the individual electrodes 23 by soldering. The common electrodes 24 are formed as electrode layer on one end surface of the piezoelectric member 12, wound around to a side of the opposite end surface mounting the individual electrodes 23, and connected to a GN electrode (common electrode line) of the FPC 15. The FPC 15 implements a driver integrated circuit (IC) to control application of driving voltage to the driving piezoelectric pillars 12A.

The nozzle plate 3 is a metal plate of, e.g., nickel (Ni) formed by electroforming The nozzle plate 3 has the nozzles 4 of a diameter of, e.g., 10 to 35 μm corresponding to the respective liquid pressure chambers 6 and is bonded to the channel plate 1 with adhesive. A liquid-repellent layer is formed on a droplet-ejection face of the nozzle plate 3 (a front face in a direction in which ink droplets are ejected from the nozzle plate 3) opposite a face facing the liquid pressure chambers 6.

At an outer side of piezoelectric actuators formed by the piezoelectric pillars 12A mounting (connected to) the FPC 15 and the base member 13 is provided the frame member 17 that is formed by injection molding of, for example, epoxy resin or polyphenylene sulfite. The frame member 17 includes the common chamber 10 and a supply port to supply ink from the outside to the common chamber 10 through a connection channel. The supply port is also connected to ink supply sources, such as sub tanks or ink cartridges.

In the liquid ejection head, the piezoelectric pillars 12A and 12B are diced at intervals of, e.g., 300 dpi and arranged in two opposed rows. In such a case, the liquid pressure chambers 6 are staggered in two rows and arranged at intervals of 150 dpi (dot per inch) in each row. Likewise, the nozzles 4 are staggered in two rows and arranged at intervals of 150 dpi in each row. Such a configuration allows image formation at a resolution of 300 dpi by single scanning.

For the liquid ejection head having the above-described configuration, for example, by decreasing the voltage applied to the driving piezoelectric pillars 12A from a reference potential, the piezoelectric pillars 12A contract. As a result, the vibration areas 2*a* of the diaphragm member 2 forming wall faces of the liquid pressure chambers 6 deform toward the base member 13 (downward in FIG. 1) to expand the volume of the liquid pressure chambers 6, thus causing ink to flow into the liquid pressure chambers 6. Then, by increasing the voltage applied to the piezoelectric pillars 12A, the piezoelectric pillars 12A extend in a laminated direction of the piezoelectric pillars 12A. As a result, the vibration areas 2*a* of the diaphragm member 2 deform toward the nozzles 4 to contract the volume of the liquid pressure chambers 6. Thus, pressure is applied to ink in the liquid pressure chambers 6 to eject (jet) droplets of the ink from the nozzles 4.

By returning the voltage applied to the driving piezoelectric pillars 12A to the reference potential, the vibration areas 2*a* of the diaphragm member 2 return to their initial positions. As a result, as the liquid pressure chambers 6 expand to generate negative pressure in the liquid pressure chambers 6, ink is replenished from the common chamber 10 to the liquid pressure chambers 6. After vibration of meniscus surface of ink in the nozzles 4 decays to a stable state, the process goes to an operation for the next droplet ejection.

It is to be noted that the method of driving the liquid ejection head is not limited to the above-described example (pull-push ejection) but, e.g., pull ejection or push ejection may be performed by changing a way of applying driving waveforms.

Next, a channel structure from liquid introducing portion to liquid pressure chamber in a first exemplary embodiment is described with reference to FIG. 3.

Figure 3:
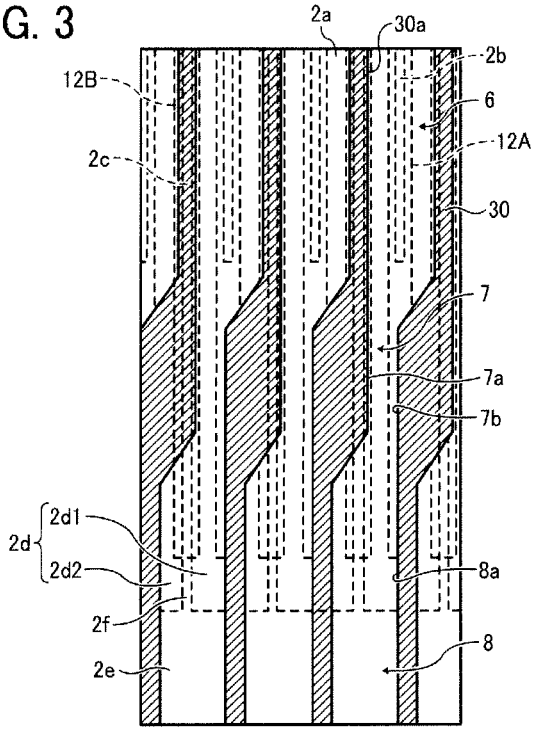
FIG. 3 is a partial sectional plan view of a channel structure from liquid introducing portion to liquid pressure chamber in a first exemplary embodiment cut along a line Y-Y of FIG. 1.

FIG. 3 is a partial sectional plan view of the liquid ejection head cut along a line Y-Y of FIG. 1.

Each driving piezoelectric pillar 12A to deform the corresponding vibration area 2*a* of the diaphragm member 2 extends to a position opposing the liquid introducing portion 8 via the fluid resistance portion 7. Hence, to prevent interference of the driving piezoelectric pillar 12A with the diaphragm member 2, a thin portion 2*d* of the first layer 2A is formed at an area of the diaphragm member 2 opposing the driving piezoelectric pillar 12A. The liquid introducing portion 8 has a width (a width in the lateral direction of the liquid pressure chamber, i.e., a direction in which the liquid pressure chambers are arrayed) greater than a width of the fluid resistance portion 7.

In a plan view (seen from above), relative to the liquid pressure chamber 6, the fluid resistance portion 7 is offset to a position closer to one of adjacent inter-channel partitions 30 than the other of the adjacent inter-channel partitions 30 in the lateral (array) direction of the liquid pressure chambers 6. Additionally, relative to the fluid resistance portion 7, the liquid introducing portion 8 is offset in the same direction as the direction in which the fluid resistance portion 7 is offset relative to the liquid pressure chamber 6 in the lateral direction of the liquid pressure chamber 6.

A wall face 30*a* of the liquid pressure chamber 6 and a first wall face 7*a* of the fluid resistance portion 7 at one end in the lateral direction of the liquid pressure chamber 6 form a single flat face in the longitudinal direction of the liquid pressure chamber 6. A second wall face 7*b* of the fluid resistance portion 7 and a wall face 8*a* of the liquid introducing portion 8 at the opposite end in the lateral direction of the liquid pressure chamber 6 form a single flat face in the longitudinal direction of the liquid pressure chamber 6.

The diaphragm member 2 also has thick portions 2*f*, each of which extends along the piezoelectric pillar 12B in the longitudinal direction of the liquid pressure chamber 6 from the thick portion 2*c*, which is bonded to the piezoelectric pillar 12B, to a thick portion 2*e* bonded to the frame member 17.

As a result, in a plan view, a thin portion 2*d* of the diaphragm member 2 forming a wall face (lower wall face in FIG. 1) of the liquid introducing portion 8 is divided into two thin areas 2*d*1 and 2*d*2 by the thick portion 2*f* formed along the direction perpendicular to the array direction of the liquid pressure chambers 6 (i.e., the longitudinal direction of the liquid pressure chamber 6) at a face of the diaphragm member 2 opposite a face on which the liquid introducing portions 8 are formed.

Such a configuration can narrow the width of each of the thin areas 2*d*1 and 2*d*2 facing the liquid introducing portion 8. Since the structural compliance of a thin layer is typically proportional to the width to the power of five, such a configuration can reduce the structural compliance. In particular, in this exemplary embodiment, the structural compliance can be reduced to a fraction of the fluid compliance of the compressibility of ink in the liquid introducing portion 8.

Next, a second exemplary embodiment of the present disclosure is described with reference to FIG. 4.

Figure 4:
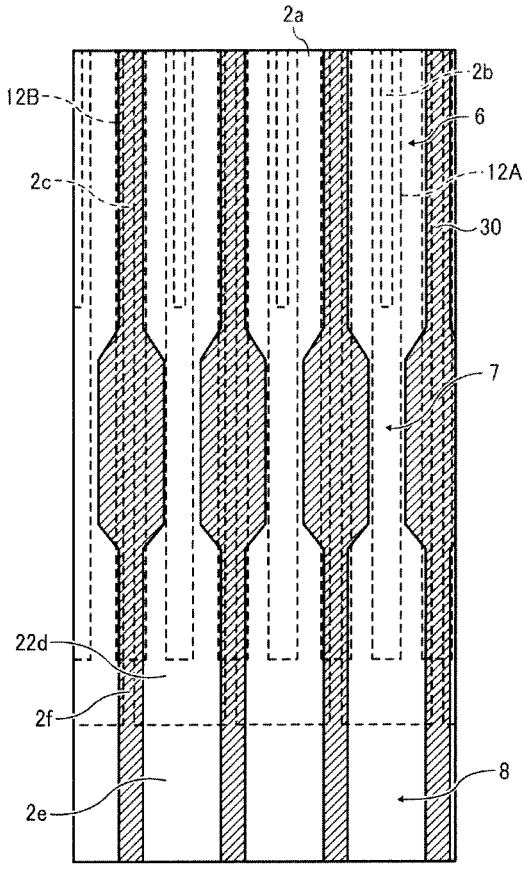
FIG. 4 is a partial sectional plan view of a channel structure in a comparative example.

FIG. 4 is a partial sectional plan view of a comparative example of a liquid ejection head cut like FIG. 3.

In the comparative example, the liquid pressure chamber 6, the fluid resistance portion 7, and the liquid introducing portion 8 are arranged so that the center lines of the liquid pressure chamber 6, the fluid resistance portion 7, and the liquid introducing portion 8 are aligned on the same line. As described above, since each driving piezoelectric pillar 12A extends to a position opposing the liquid introducing portion 8, the diaphragm member 2 preferably has thin portions (corresponding to the thin portions 2*d* in the above-described first exemplary embodiment) at areas opposing the driving piezoelectric pillars 12A. Hence, the liquid ejection head of the comparative example has thin portions 22*d* entirely formed as a single plate. As a result, the structural compliance of the thin portions 22*d* forming wall faces of the liquid introducing portions 8 increase, and natural vibration due to fluctuations in pressure at the ejection of liquid droplets occurs, thus destabilizing the droplet ejection performance.

By contrast, in the first exemplary embodiment, the thin areas 2*d*1 and 2*d*2 of the diaphragm member 2 forming the wall faces of the liquid introducing portions 8 have narrow widths, thus reducing the structural compliance. Such a configuration can minimize or prevent natural vibration due to fluctuations in pressure at the ejection of liquid droplets, thus stabilizing the droplet ejection performance.

Next, a channel structure from liquid introducing portion to liquid pressure chamber in a second exemplary embodiment is described with reference to FIG. 5.

Figure 5:
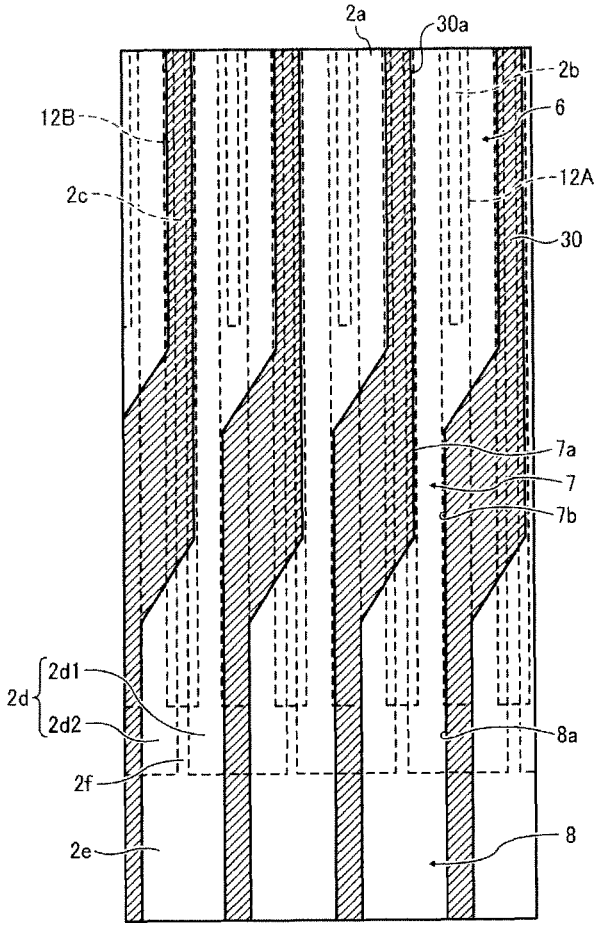
FIG. 5 is a partial sectional plan view of a channel structure from liquid introducing portion to liquid pressure chamber in a second exemplary embodiment.

FIG. 5 is a partial sectional plan view of a liquid ejection head in the second exemplary embodiment cut like FIG. 3.

In this exemplary embodiment, each thin portion 2*d* forming a wall face of a liquid introducing portion 8 is divided into two thin areas 2*d*1 and 2*d*2 having the same width. In other words, each liquid introducing portion 8 has such a position and shape that the thin areas 2*d*1 and 2*d*2 divided by a thick portion 2*f* have the same width.

In other words, if the liquid introducing portions 8 have a uniform width and the thick portions 2*f* dividing the thin portions 2*d* have a uniform width, arranging each thick portion 2*f* at a position along a central axis of the liquid introducing portion 8 with respect to the lateral direction of the pressure liquid chamber 6 can minimize the structural compliance of the divided thin areas 2*d*1 and 2*d*2. As a result, such a configuration can more effectively reduce the structural compliance than the above-described first exemplary embodiment, thus more stabilizing the droplet ejection performance.

Next, a channel structure from liquid introducing portion to liquid pressure chamber in a third exemplary embodiment is described with reference to FIG. 6.

Figure 6:
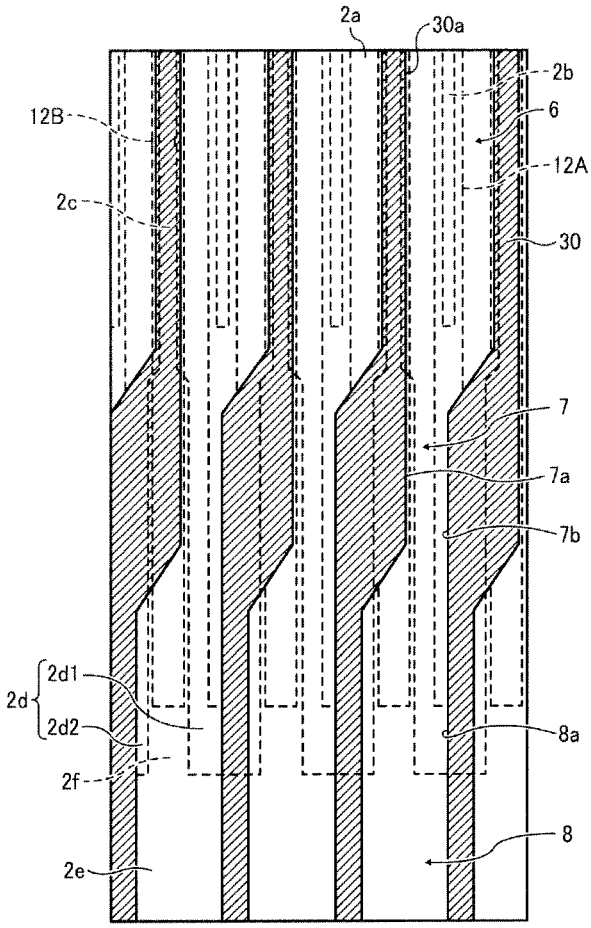
FIG. 6 is a partial sectional plan view of a channel structure from liquid introducing portion to liquid pressure chamber in a third exemplary embodiment.

FIG. 6 is a partial sectional plan view of a liquid ejection head in the third exemplary embodiment cut like FIG. 3.

In this exemplary embodiment, each thin portion 2*d* forming a wall face of a liquid introducing portion 8 is divided into thin areas 2*d*1 and 2*d*2 by a thick portion 2*f*, and the thick portion 2*f* has a width greater than a width of a thick portion 2*c* opposing an inter-channel partition 30.

As a result, each of the thin areas 2*d*1 and 2*d*2 can have a width smaller than any of the first and second the second exemplary embodiments. Such a configuration can further minimize the structural compliance, thus more stabilizing the droplet ejection performance.

Next, a channel structure from liquid introducing portion to liquid pressure chamber in a fourth exemplary embodiment is described with reference to FIG. 7.

Figure 7:
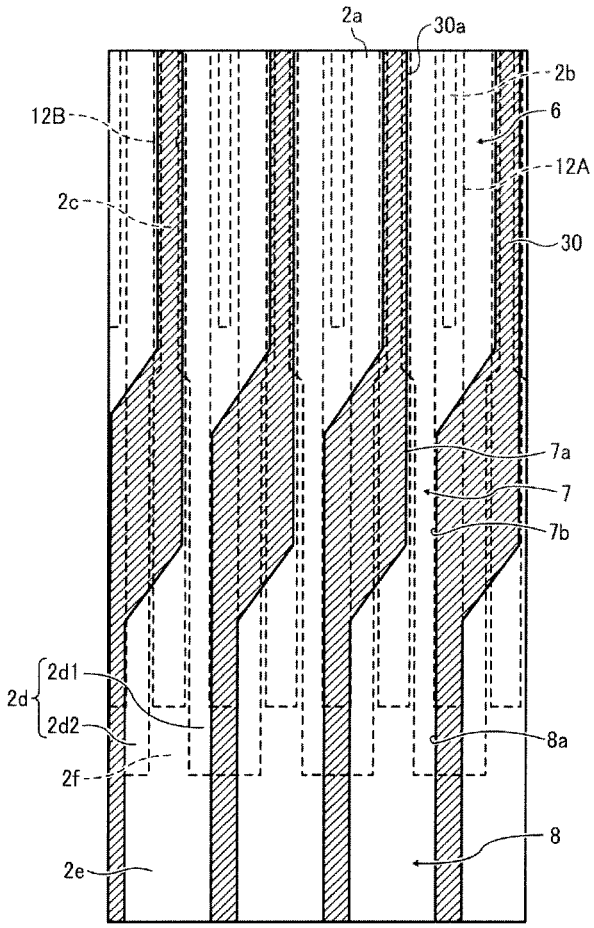
FIG. 7 is a partial sectional plan view of a channel structure from liquid introducing portion to liquid pressure chamber in a fourth exemplary embodiment.

FIG. 7 is a partial sectional plan view of a liquid ejection head in the fourth exemplary embodiment cut like FIG. 3.

In this exemplary embodiment, as with the above-described third exemplary embodiment, each thin portion 2*d* forming a wall face of a liquid introducing portion 8 is divided into thin areas 2*d*1 and 2*d*2 by a thick portion 2*f*, and the thick portion 2*f* has a width greater than a width of a thick portion 2*c* opposing an inter-channel partition 30. Additionally, unlike the above-described third exemplary embodiment, the two thin areas 2*d*1 and 2*d*2 have the same width.

Such a configuration can obtain combined effects of the above-described second and third exemplary embodiments, thus further minimizing the structural compliance and stabilizing the droplet ejection performance.

Next, a channel structure from liquid introducing portion to liquid pressure chamber in a fifth exemplary embodiment is described with reference to FIG. 8.

Figure 8:
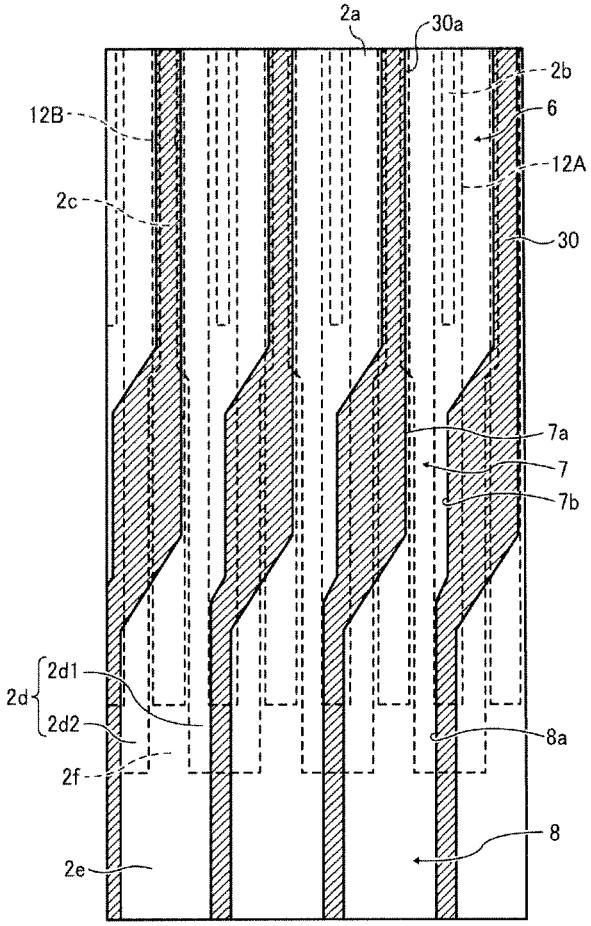
FIG. 8 is a partial sectional plan view of a channel structure from liquid introducing portion to liquid pressure chamber in a fifth exemplary embodiment.

FIG. 8 is a partial sectional plan view of a liquid ejection head in the fifth exemplary embodiment cut like FIG. 3.

In this exemplary embodiment, a second wall face 7*b* of each fluid resistance portion 7 (opposing a first wall face 7*a* forming a single flat face with a wall face 30*a* of a liquid pressure chamber 6) is offset relative to a wall face 8*a* of a liquid introducing portion 8. Each thin portion 2*d* forming a wall face of the corresponding liquid introducing portion 8 is divided into two thin areas 2*d*1 and 2*d*2 having the same width.

Even in a case where channels are formed by wet etching a silicon substrate, the position of the liquid introducing portion 8 can be further offset relative to the fluid resistance portion 7 in a range smaller than the width of the fluid resistance portion 7. Such a configuration can reduce the structural compliance of the liquid introducing portions 8 while obtaining an increased degree of freedom in design of the fluid resistance portions 7.

Next, a channel structure from liquid introducing portion to liquid pressure chamber in a sixth exemplary embodiment is described with reference to FIG. 9.

Figure 9:
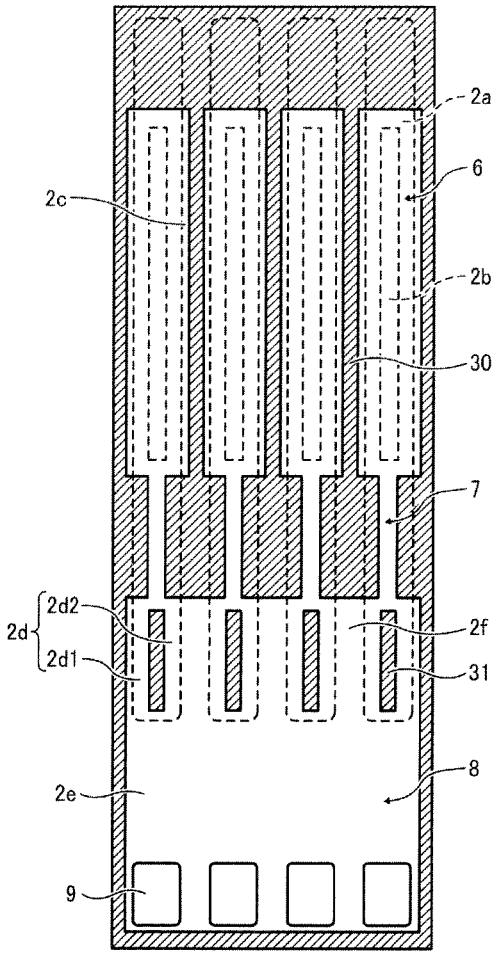
FIG. 9 is a partial sectional plan view of a channel structure from liquid introducing portion to liquid pressure chamber in a sixth exemplary embodiment.

FIG. 9 is a partial sectional plan view of a liquid ejection head in the sixth exemplary embodiment cut like FIG. 3.

In this exemplary embodiment, as with the above-described comparative example, liquid pressure chambers 6, fluid resistance portions 7, and liquid introducing portions 8 are arranged so that the center lines of the liquid pressure chamber 6, the fluid resistance portion 7, and the liquid introducing portion 8 are aligned on the same line. As described above, since each driving piezoelectric pillar 12A extends to a position opposing the corresponding liquid introducing portion 8, the diaphragm member 2 has thin portions 2*d* at areas opposing the driving piezoelectric pillars 12A.

The channel plate 1 has insular support portions (partitioning portions) 31, and the thin portions 2*d* of the diaphragm member 2 forming wall faces of the liquid introducing portions 8 are fixedly bonded to the support portions 31. The support portion 31 has the same width as that of the fluid resistance portion 7.

As described above, by fixedly bonding the thin portions 2*d* of the diaphragm member 2 to the support portions 31 of the channel plate 1, each thin portion 2*d* forming a wall face of the corresponding liquid introducing portion 8 is substantively divided into two thin areas 2*d*1 and 2*d*2.

As with the above-described first exemplary embodiment, such a configuration can narrow the width of each of the thin areas 2*d*1 and 2*d*2 of the diaphragm member 2 facing the liquid introducing portion 8. Since the structural compliance of a thin layer is proportional to the width to the power of five, such a configuration can reduce the structural compliance, and as a result, minimize or prevent natural vibration due to fluctuations in pressure at the ejection of droplets, thus stabilizing the droplet ejection performance.

Next, a channel structure from liquid introducing portion to liquid pressure chamber in a seventh exemplary embodiment is described with reference to FIG. 10.

Figure 10:
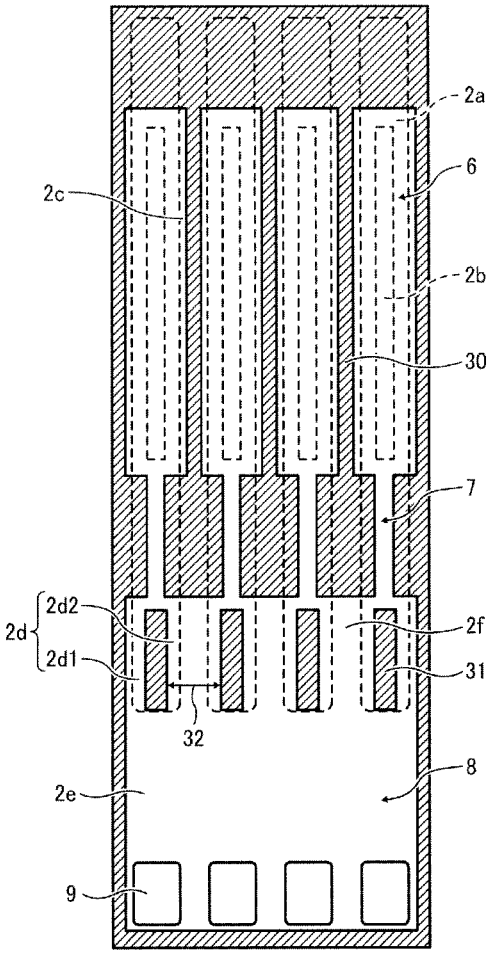
FIG. 10 is a partial sectional plan view of a channel structure from liquid introducing portion to liquid pressure chamber in a seventh exemplary embodiment.

FIG. 10 is a partial sectional plan view of a liquid ejection head in the seventh exemplary embodiment cut like FIG. 3.

In this exemplary embodiment, each of support portions 31 of a channel plate 1 extends to a thick portion 2*e* of a diaphragm member 2. The support portion 31 has a width greater than a width of the fluid resistance portion 7. An interval between adjacent support portions 31 indicated by an arrow 32 in FIG. 10 is set to be such a distance as not to create a resistance (resistance to fluid flow) affecting droplet ejection.

Such a configuration can further narrow the width of each of the thin areas 2*d*1 and 2*d*2 facing the liquid introducing portion 8. As a result, the structural compliance can be more reduced, thus further stabilizing the droplet ejection performance.

Next, a channel structure from liquid introducing portion to liquid pressure chamber in an eighth exemplary embodiment is described with reference to FIG. 11.

Figure 11:
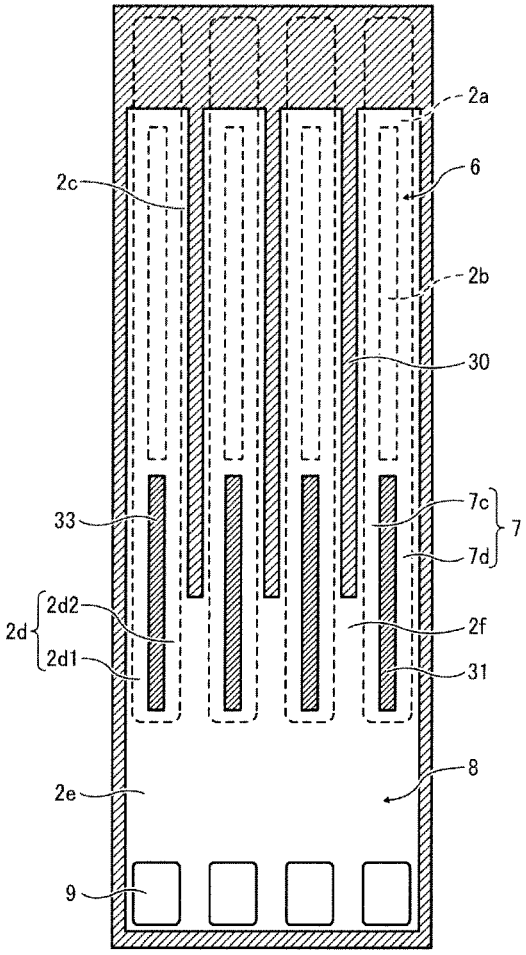
FIG. 11 is a partial sectional plan view of a channel structure from liquid introducing portion to liquid pressure chamber in an eighth exemplary embodiment.

FIG. 11 is a partial sectional plan view of a liquid ejection head in the eighth exemplary embodiment cut like FIG. 3.

In this exemplary embodiment, a channel plate 1 includes partitioning portions 31. Each partitioning portion 33 is formed between a liquid pressure chamber 6 and a liquid introducing portion 8 so as to continuously extend from an end of a support portion 31 proximal to the liquid pressure chamber 6. As a result, each fluid resistance portion 7 is divided into two channels, i.e., a first flow channel 7*c* and a second flow channel 7*d*.

As described above, by extending the partitioning portion 33 for forming the fluid resistance portion 7 to the liquid introducing portion 8, the structural compliance of the thin portion 2*d* forming a wall face of the liquid introducing portion 8 can be minimized in a simple configuration.

Next, a channel structure from liquid introducing portion to liquid pressure chamber in a ninth exemplary embodiment is described with reference to FIG. 12.

Figure 12:
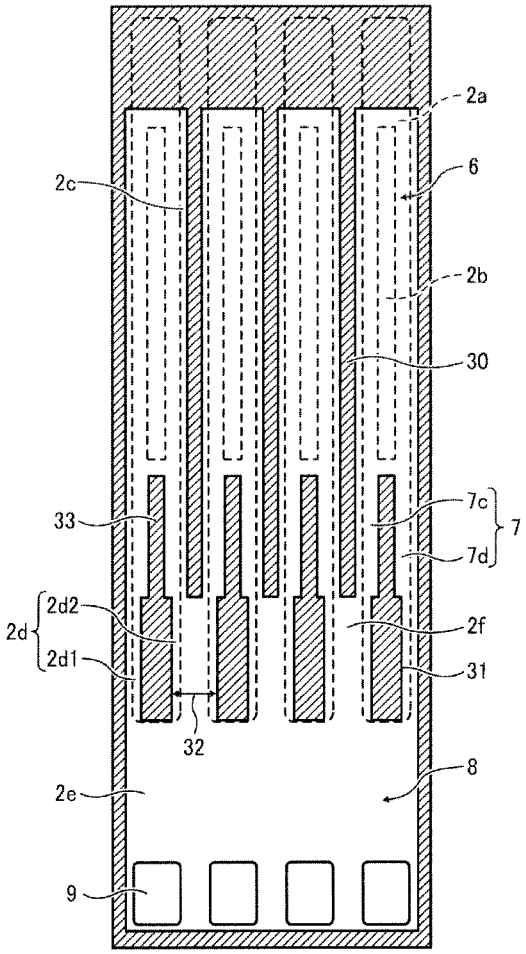
FIG. 12 is a partial sectional plan view of a channel structure from liquid introducing portion to liquid pressure chamber in a ninth exemplary embodiment.

FIG. 12 is a partial sectional plan view of a liquid ejection head in the ninth exemplary embodiment cut like FIG. 3.

This exemplary embodiment has the same configuration as the eighth exemplary embodiment except that a support portion 31 proximal to a liquid introducing portion 8 has a width greater than a width of a partitioning portion 33 disposed between flow channels 7*c* and 7*d* of each fluid resistance portion 7. An interval between adjacent support portions 31 indicated by an arrow 32 in FIG. 12 is set to be such a distance as not to create a resistance (resistance to fluid flow) affecting droplet ejection.

Such a configuration can further narrow the width of each of the thin areas 2*d*1 and 2*d*2 at the liquid introducing portion 8. As a result, the structural compliance can be more reduced, thus further stabilizing the droplet ejection performance.

In any of the above-described exemplary embodiments, the liquid ejection head may be integrally molded with sub tanks for supplying ink to form a head-integrated ink cartridge.

Next, an image forming apparatus having liquid ejection heads according to an exemplary embodiment of the present disclosure is described with reference to FIGS. 13 and 14.

Figure 13:
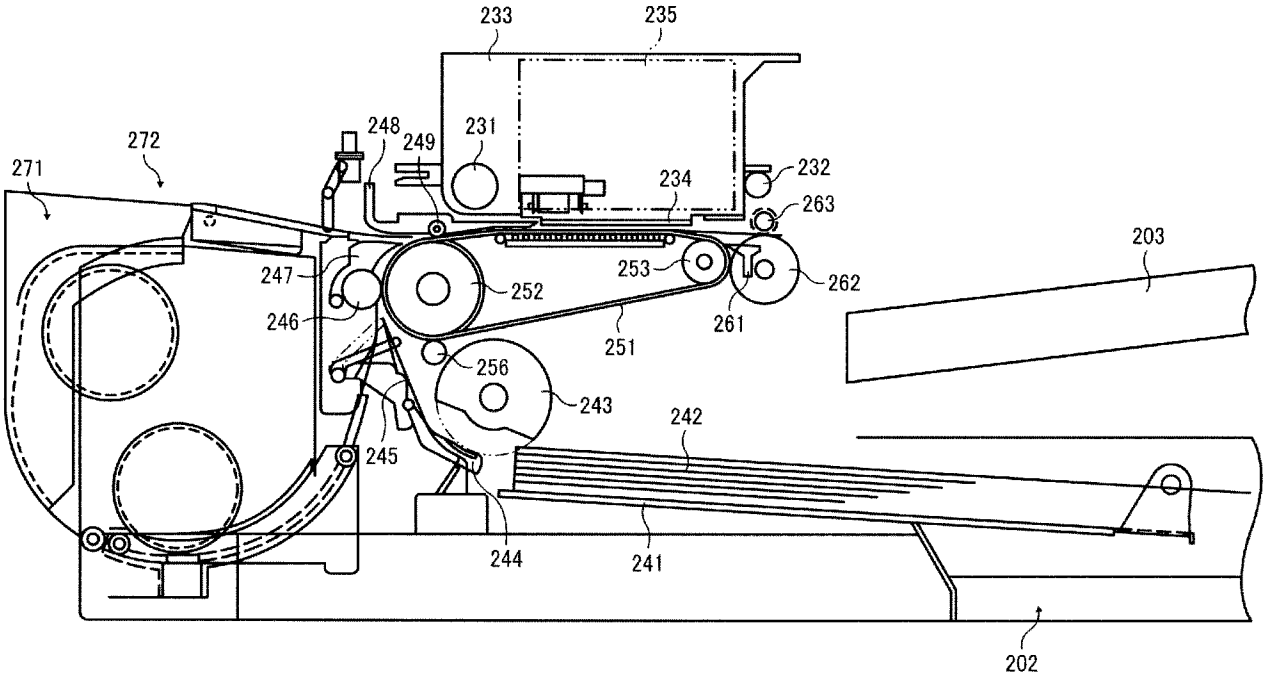
FIG. 13 is a schematic side view of a mechanical section of an image forming apparatus including liquid ejection heads according to an exemplary embodiment of this disclosure.

FIG. 13 is a side view of a mechanical section of the image forming apparatus. FIG. 14 is a partial plan view of the mechanical section of the image forming apparatus of FIG. 13.

The image forming apparatus is a serial-type image forming apparatus and includes a main left-side plate 221A, a main right-side plate 221B, a main guide rod 231, a sub guide rod 232, and a carriage 233. The main guide rod 231 and the sub guide rod 232 serving as guide members extend between the main side plates 221A and 221B to support the carriage 233. The carriage 233 supported by the main guide rod 231 and the sub guide rod 232 is slidable in a main scanning direction indicated by an arrow MSD in FIG. 14. The carriage 233 is reciprocally moved for scanning in the main scanning direction MSD by a main scanning motor via a timing belt.

On the carriage 233 is mounted a recording head 234 including liquid ejection head units 234*a* and 234*b*. Each of the liquid ejection head units 234*a* and 234*b* may include the liquid ejection head according to any of the above-described exemplary embodiments to eject ink droplets of different colors, for example, yellow (Y), cyan (C), magenta (M), and black (K), and a sub tank integrally molded with the liquid ejection head to store ink supplied to the head. The recording head 234 is mounted on the carriage 233 so that multiple nozzle rows each including multiple nozzles are arranged parallel to a sub scanning direction (indicated by an arrow SSD illustrated in FIG. 14) perpendicular to the main scanning direction MSD and ink droplets are ejected downward from the nozzles.

In the recording head 234, the liquid ejection head units 234*a* and 234*b* are mounted on a base member. Each of the liquid ejection head units 234*a* and 234*b* includes, for example, two nozzle rows. In such a case, for example, the liquid ejection head unit 234*a* ejects droplets of black ink from one of the nozzle rows and droplets of cyan ink from the other of the nozzle rows, and the liquid ejection head unit 234*b* ejects droplets of magenta ink from one of the nozzle rows and droplets of yellow ink from the other of the nozzle rows. In FIG. 12, as described above, the recording head 234 has two liquid ejection heads for ejecting liquid droplets of four colors. However, it is to be noted that the recording head may have, for example, four liquid ejection heads for separately eject ink droplets of four different colors.

A supply unit 224 replenishes different color inks from corresponding ink cartridges 210 to sub tanks 235 of the recording head 234 via supply tubes 236 for the respective color inks.

The image forming apparatus further includes a sheet feed section that feeds sheets 242 stacked on a sheet stack portion (platen) 241 of a sheet feed tray 202. The sheet feed section further includes a sheet feed roller 243 that separates the sheets 242 from the sheet stack portion 241 and feeds the sheets 242 sheet by sheet and a separation pad 244 that is disposed opposing the sheet feed roller 243. The separation pad 244 is made of a material of a high friction coefficient and urged toward the sheet feed roller 243.

To feed the sheet 242 from the sheet feed section to an area below the recording head 234, the image forming apparatus includes a first guide member 245 that guides the sheet 242, a counter roller 246, a conveyance guide member 247, a regulation member 248 including a front-end press roller 249, and a conveyance belt 251 that conveys the sheet 242 to a position facing the recording head 234 with the sheet 242 electrostatically adhered thereon.

The conveyance belt 251 is an endless belt that is looped between a conveyance roller 252 and a tension roller 253 so as to circulate in a belt conveyance direction, that is, the sub-scanning direction (SSD). A charging roller 256 is provided to charge a surface of the conveyance belt 251. The charging roller 256 is disposed to contact the surface of the conveyance belt 251 and rotate by the circulation of the conveyance belt 251. When the conveyance roller 252 is rotationally driven by a sub-scanning motor via a timing roller, the conveyance belt 251 circulates in the belt conveyance direction SSD illustrated in FIG. 14.

The image forming apparatus further includes a sheet output section to output the sheet 242 having an image formed by the recording head 234. The sheet output section includes a separation claw 261 to separate the sheet 242 from the conveyance belt 251, a first output roller 262, and a second output roller 263. Additionally, the sheet output tray 203 is disposed below the first output roller 262.

A duplex unit 271 is removably mounted on a rear face portion of the image forming apparatus. When the conveyance belt 251 rotates in reverse to return the sheet 242, the duplex unit 271 receives the sheet 242 and turns the sheet 242 upside down to feed the sheet 242 between the counter roller 246 and the conveyance belt 251. A manual-feed tray 272 is formed at the top face of the duplex unit 271.

Figure 14:
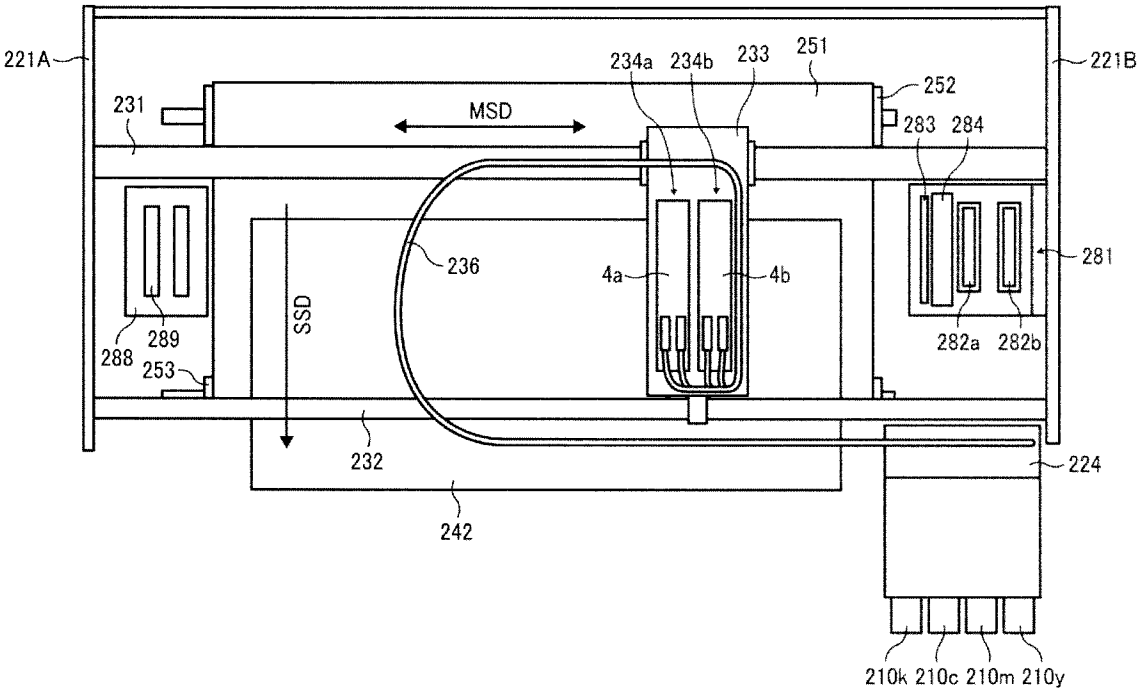
FIG. 14 is a schematic plan view of the mechanical section of FIG. 13.

In FIG. 14, at a non-print area on one end in the main scanning direction MSD of the carriage 233 is disposed a maintenance unit 281 to maintain and recover conditions of the nozzles of the recording head 234. The maintenance unit 281 includes cap members 282*a* and 282*b* (hereinafter collectively referred to as "caps 282" unless distinguished) to cover nozzle faces of the recording head 234, a wiping blade 283 serving as a blade member to wipe the nozzle faces of the recording head 234, and a first droplet receiver 284 to store liquid droplets ejected during maintenance ejection in which liquid droplets not contributing to image recording are ejected to discharge increased-viscosity recording liquid.

In FIG. 14, a second droplet receiver 288 is disposed at a non-print area on the other end in the main scanning direction MSD of the carriage 233. The second droplet receiver 288 stores liquid droplets not contributing to a resultant image and ejected to discharge increased-viscosity recording liquid during recording (image forming) operation and so forth. The second droplet receiver 288 has openings 289 arranged in parallel with the nozzles rows of the recording head 234.

In the image forming apparatus having the above-described configuration, the sheets 242 are separated sheet by sheet from the sheet feed tray 202, fed in a substantially vertically upward direction, guided along the first guide member 245, and conveyed while being sandwiched with the conveyance belt 251 and the counter roller 246. Further, the front tip of the sheet 242 is guided with the conveyance guide 237 and pressed with the front-end press roller 249 against the conveyance belt 251 so that the traveling direction of the sheet 242 is turned substantially 90 angle degrees.

At this time, plus outputs and minus outputs, i.e., positive and negative supply voltages are alternately applied to the charging roller 256 so that the conveyance belt 251 is charged with an alternating voltage pattern, that is, an alternating band pattern of positively-charged areas and negatively-charged areas in the sub-scanning direction SSD, i.e., the belt circulation direction. When the sheet 242 is fed onto the conveyance belt 251 alternately charged with positive and negative charges, the sheet 242 is electrostatically adhered onto the conveyance belt 251 and conveyed in the sub-scanning direction SSD by circulation of the conveyance belt 251.

By driving the recording head 234 in response to image signals while moving the carriage 233, ink droplets are ejected on the sheet 242 stopped below the recording head 234 to form one band of a desired image. Then, the sheet 242 is fed by a certain amount to prepare for recording another band of the image. Receiving a signal indicating that the image has been recorded or the rear end of the sheet 242 has arrived at the recording area, the recording head 234 finishes the recording operation and outputs the sheet 242 to the sheet output tray 203.

As described above, the image forming apparatus can employ, as the recording head, the liquid ejection head according to any of the above-described exemplary embodiments, thus allowing stable formation of high-quality images.

In the above-described exemplary embodiments, the image forming apparatus is described as a serial-type image forming apparatus. However, it is to be noted that the image forming apparatus is not limited to the serial-type image forming apparatus but the liquid ejection head may be mounted on, for example, a line-head-type image forming apparatus. In the above-described exemplary embodiments, the liquid ejection head is described to have the bi-pitch structure. However, it is to be noted that the structure of the liquid ejection head is not limited to the bi-pitch structure but may be, for example, a normal pitch structure (in which, e.g., both the above-described piezoelectric pillars 12A and 12B are driving piezoelectric pillars).

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid ejection head comprising:

a channel plate including a separate liquid chamber communicating with a nozzle to eject droplets of liquid, a fluid resistance portion communicating with the separate liquid chamber, and a liquid introducing portion communicating with the fluid resistance portion to introduce the liquid from a common liquid chamber;

a diaphragm member having a thin layer and a thick layer, the thin layer forming a wall face of each of the separate liquid chamber, the fluid resistance portion, and the liquid introducing portion, the thin layer including a vibration area facing the separate liquid chamber; and a piezoelectric member arranged to deform the vibration area facing the separate liquid chamber, the piezoelectric member having a portion opposing the liquid introducing portion at one end in a longitudinal direction of the separate liquid chamber perpendicular to a lateral direction of the separate liquid chamber, wherein the thin layer of the diaphragm member has a thin portion forming the wall face of the liquid introducing portion, the thick layer of the diaphragm member has a first thick portion formed along the longitudinal direction of the separate liquid chamber on a first face of the thin portion opposite a second face of the thin portion opposing the liquid introducing portion, and in a plan view, the thin portion forming the wall face of the liquid introducing portion is divided in the lateral direction by the first thick portion formed along the longitudinal direction of the separate liquid chamber.

2. The liquid ejection head of claim 1, wherein the thin portion is divided by the first thick portion to areas having a uniform width.

3. The liquid ejection head of claim 1, wherein, relative to the separate liquid chamber, the fluid resistance portion is offset closer to one of adjacent inter-chamber partitions of the separate liquid chamber than the other of the adjacent inter-chamber partitions in the lateral direction of the separate liquid chamber, and relative to the fluid resistance portion, the liquid introducing portion offset in a direction in which the fluid resistance portion is offset with respect to the lateral direction of the separate liquid chamber.

4. The liquid ejection head of claim 3, wherein a wall face of the fluid resistance portion and a wall face of the liquid introducing portion disposed at one end in the lateral direction of the separate liquid chamber form a single flat face along the longitudinal direction of the separate liquid chamber.

5. The liquid ejection head of claim 3, wherein a wall face of the separate liquid chamber and a wall face of the fluid resistance portion disposed at one end in the lateral direction of the separate liquid chamber form a single flat face along the longitudinal direction of the separate liquid chamber.

6. The liquid ejection head of claim 1, wherein the thick layer of the diaphragm member has a second thick portion facing the vibration area of the thin layer, the second thick portion being formed along the longitudinal direction of the separate liquid chamber and contacting the piezoelectric member, and in the lateral direction of the separate liquid chamber, the first thick portion has a width greater than a width of the second thick portion.

7. An image forming apparatus comprising the liquid ejection head of claim 1.

8. The liquid ejection head of claim 1, wherein a width of the first thick portion in the lateral direction of the separate liquid chamber is smaller than a width of the thin portion in the lateral direction of the separate liquid chamber.

9. The liquid ejection head of claim 1, wherein the wall face of the liquid introducing portion includes areas formed only of the thin portion of the thin layer, and the first thick portion of the thick layer is disposed, in the plan view, between the areas formed only of the thin portion.

* * * * *